US007426357B2

(12) United States Patent
Mori

(10) Patent No.: US 7,426,357 B2
(45) Date of Patent: Sep. 16, 2008

(54) FIXING UNIT AND IMAGE FORMING APPARATUS EQUIPPED WITH THE FIXING UNIT

(75) Inventor: Shuhei Mori, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 281 days.

(21) Appl. No.: 11/240,650

(22) Filed: Sep. 30, 2005

(65) Prior Publication Data

US 2006/0067748 A1 Mar. 30, 2006

(30) Foreign Application Priority Data

Sep. 30, 2004 (JP) ..... 2004-288394
Sep. 30, 2004 (JP) ..... 2004-288395

(51) Int. Cl.
*G03G 15/16* (2006.01)
*G03G 15/20* (2006.01)

(52) U.S. Cl. ..... 399/122; 399/320

(58) Field of Classification Search ..... 399/94, 399/122, 401, 320, 328
See application file for complete search history.

(56) References Cited

U.S. PATENT DOCUMENTS 5,680,651 A * 10/1997 Tsuji et al. ..... 399/401

FOREIGN PATENT DOCUMENTS

| | | | |
|---|---|---|---|
| JP | 62-164552 | | 7/1987 |
| JP | 01-274161 | | 11/1989 |
| JP | 04184380 | A * | 7/1992 |
| JP | 07-072692 | | 3/1995 |
| JP | 08-334944 | | 12/1996 |
| JP | 11-245488 | | 9/1999 |
| JP | 2001-005239 | | 1/2001 |
| JP | 2002-014556 | | 1/2002 |
| JP | 2003-341176 | | 12/2003 |

OTHER PUBLICATIONS

English Translation of JP 2003-341176.*

* cited by examiner

*Primary Examiner*—David M Gray
*Assistant Examiner*—Joseph S. Wong
(74) *Attorney, Agent, or Firm*—Hogan & Hartson LLP

(57) ABSTRACT

A fixing unit for fixing a toner image to a recording medium by passing the recording medium which carries an unfixed image between a pair of rollers which are rotated with being pressed to each other to apply heat and pressure to the recording medium thereby fixing the unfixed image onto the recording medium. The fixing unit includes a housing in which the pair of rollers are provided, the housing having an outer surface; a plate-shaped member for indicating information; and a holding structure for physically holding the plate-shaped member on the outer surface of the housing in a removable manner.

8 Claims, 11 Drawing Sheets

FIXING UNIT AND IMAGE FORMING APPARATUS EQUIPPED WITH THE FIXING UNIT

CROSS-REFERENCE

The entire disclosures of Japanese Patent Applications No. 2004-288395 and No. 288393 both filed on Sep. 30, 2004 are expressly incorporated by reference herein.

BACKGROUND OF THE INVENTION

1. Field of the Invention

The present invention is related to a fixing unit and an image forming apparatus equipped with the fixing unit.

2. Description of the Prior Art

In general, an image forming apparatus such as a printer, a copying machine, a fax machine or the like which uses electronic photography is provided with a fixing unit. The fixing unit is provided for heating a recording medium such as paper or the like which carries a toner image formed from toner in an unfixed state and for applying pressure thereto to fix the toner image onto the recording medium (see JP-A No. 2001-5239).

This fixing unit includes a pair of cylindrical rollers which are rotated with being pressed to each other, and a heat source which heats one of these rollers. By passing the recording medium through the nip formed by the pair of rollers which are pressed to each other, and applying heat and pressure to the recording medium, the toner image formed on the recording medium is fixed onto the recording medium.

Further, in the prior art mentioned above, in order to achieve the objectives such as preventing a user from touching the high-temperature roller and ensuring safety, the pair of rollers is housed inside a housing to cover the periphery of the pair of rollers except for the recording medium passage area. Further, because this housing also reaches a relatively high temperature, a warning label having a warning about high temperature is affixed to the outer surface of the housing with an adhesive.

However, if an adhesive of the type that is resistant to the high temperature of the outer surface of the housing is not used, the label can peel off from the outer surface of the housing during the use of the fixing unit, and there are cases where this makes it impossible to give such warning when necessary. On the other hand, when an adhesive of the type that is resistant to the high temperature of the outer surface of the housing is used in order to prevent the problem mentioned above, it becomes difficult to peel off the label from the outer surface of the housing at the time when the fixing unit is to be recycled, and this becomes a hindrance to recycling operations.

SUMMARY OF THE INVENTION

Accordingly, it is an object of the present invention to provide a fixing unit and an image forming apparatus equipped with the fixing unit which makes it possible to indicate information to the outside of the fixing unit when necessary while reducing the burden of operations such as recycling operations and the like.

In order to achieve the above-mentioned object, the present invention is directed to a fixing unit for fixing a toner image onto a recording medium by passing the recording medium which carries an unfixed image between a pair of rollers which are rotated with being pressed to each other to apply heat and pressure to the recording medium thereby fixing the unfixed image onto the recording medium. The fixing unit comprises a housing in which the pair of rollers are provided, the housing having an outer surface; a plate-shaped member for indicating information; and holding means for physically holding the plate-shaped member on the outer surface of the housing in a removable manner.

According to the fixing unit of the present invention, it is possible to indicate information outside the housing when necessary as well as to reduce the burden of operations such as recycling operation.

In the fixing unit of the present invention, it is preferred that the holding means includes linear openings formed on the housing and portions of the plate-shaped member which are inserted into the linear openings.

This makes it possible to hold the plate-shaped member on the outer surface of the housing with simple and inexpensive structure without using any fasteners such as machine screws. Further, the plate-shaped member can be removed easily when necessary as compared to the case where fasteners are used. As a result, the burden of the recycling operation can be further reduced.

Further, in the fixing unit of the present invention, it is preferred that the housing has a plurality of rib-shaped portions formed on the outer surface thereof, and the linear openings include notches formed in some of the rib-shaped portions at the side of the outer surface of the housing so as to provide an elongated space into which the plate-shape member is inserted.

According to this structure, since the housing is reinforced by the rib-shaped portions, the strength of the housing is enhanced as well as the burden of the recycling operation can be reduced while indicating the information outside the fixing unit when necessary. Further, since the plate-shaped member is protected by the rib-shaped portions, it is possible to prevent the plate-shaped member from being fallen off from the fixing unit accidentally.

Further, in the fixing unit of the present invention, it is also preferred that each of the rib-shaped portions has a ridge surface, and the ridge surfaces of the rib-shaped portions form a guide surface for guiding the recording medium along the outer surface of the housing in a longitudinal direction of the rib-shaped portions.

This makes it possible to reduce the burden of the recycling operation while indicating the information outside the housing when necessary. Further, since the outer surface of the housing can be utilized effectively as the guide surface, it is also possible to reduce manufacturing costs of the fixing unit and the image forming apparatus equipped with the fixing unit.

Further, in the fixing unit of the present invention, it is also preferred that the holding means includes a pair of slits formed on the outer surface of the housing in a spaced apart manner, and opposite sides of the plate-shape member in a longitudinal direction thereof are inserted into the slits, respectively.

This makes it possible to removably attach the plate-shape member onto the outer surface of the housing with quite simple operation.

Furthermore, in the fixing unit of the present invention, it is also preferred that the holding means includes engagement portions comprised of holes formed in one of the housing and the plate-shaped member and protrusions formed in the other to be engaged with the holes.

According to this structure, it is possible to remove the plate-shape member from the housing easily when necessary such as at a time of maintenance. Further, it is also possible to prevent the plate-shape member from being fallen off from the housing accidentally.

Furthermore, in the fixing unit of the present invention, it is also preferred that the engaging portions are configured so as to allow the relative movement between the plate-shape member and the housing for absorbing thermal expansion of the plate-shaped member.

According to this structure, it is also possible to remove the plate-shape member from the housing easily when necessary such as at a time of maintenance. Further, it is also possible to prevent the plate-shape member from being fallen off from the housing accidentally.

Furthermore, in the fixing unit of the present invention, it is also preferred that the holding means includes a magnetic force generating portion provided on one of the housing and the plate-shaped member for generating a magnetic force and an attracted portion provided in at least a part of the other and formed of a material that is attracted to the magnetic force generation portion.

According to this structure, it is also possible to remove the plate-shape member from the housing easily when necessary such as at a time of maintenance. Further, it is also possible to prevent the plate-shape member from being fallen off from the housing accidentally.

Moreover, in the fixing unit of the present invention, it is also preferred that the housing has an aperture for adjusting the distance between the axes of the pair of rollers from the outside of the housing and/or for adjusting the position of components disposed in contact with or in the vicinity of the rollers, and the plate-shaped member is attached so as to cover the aperture.

This makes it possible to prevent the adjustment of the distance between the axes of the pair of rollers is carried out accidentally while the adjustment can be carried out by removing the plate-shaped member when necessary.

Moreover, in the fixing unit of the present invention, it is also preferred that the plate-shaped member is formed of a flexible material.

According to this structure, it is also possible to remove the plate-shape member from the housing easily when necessary such as at a time of maintenance. Further, it is also possible to prevent the plate-shape member from being fallen off from the housing accidentally.

Another aspect of the present invention is directed to an image forming apparatus equipped with the fixing unit as described above.

According to the invention described above, it is possible to provide an image forming apparatus equipped with a fixing unit by which the burden of the recycling operation can be reduced while indicating the information outside the fixing unit when necessary.

These and other objects, structures and advantages of the present invention will be apparent from the following detailed description of the preferred embodiments which proceeds with reference to the accompanying drawings.

DETAILED DESCRIPTION OF THE PREFERRED EMBODIMENTS

The preferred embodiments of a fixing unit and an image forming apparatus equipped with the fixing unit of the present invention will be described in detail below with reference to the appended drawings.

First Embodiment

The first embodiment of the present invention will be described with reference to FIGS. 1 to 6.

Image Forming Apparatus

Before describing the fixing unit of the present invention, the image forming apparatus equipped with the fixing unit of the present invention will be described briefly.

Figure 1:
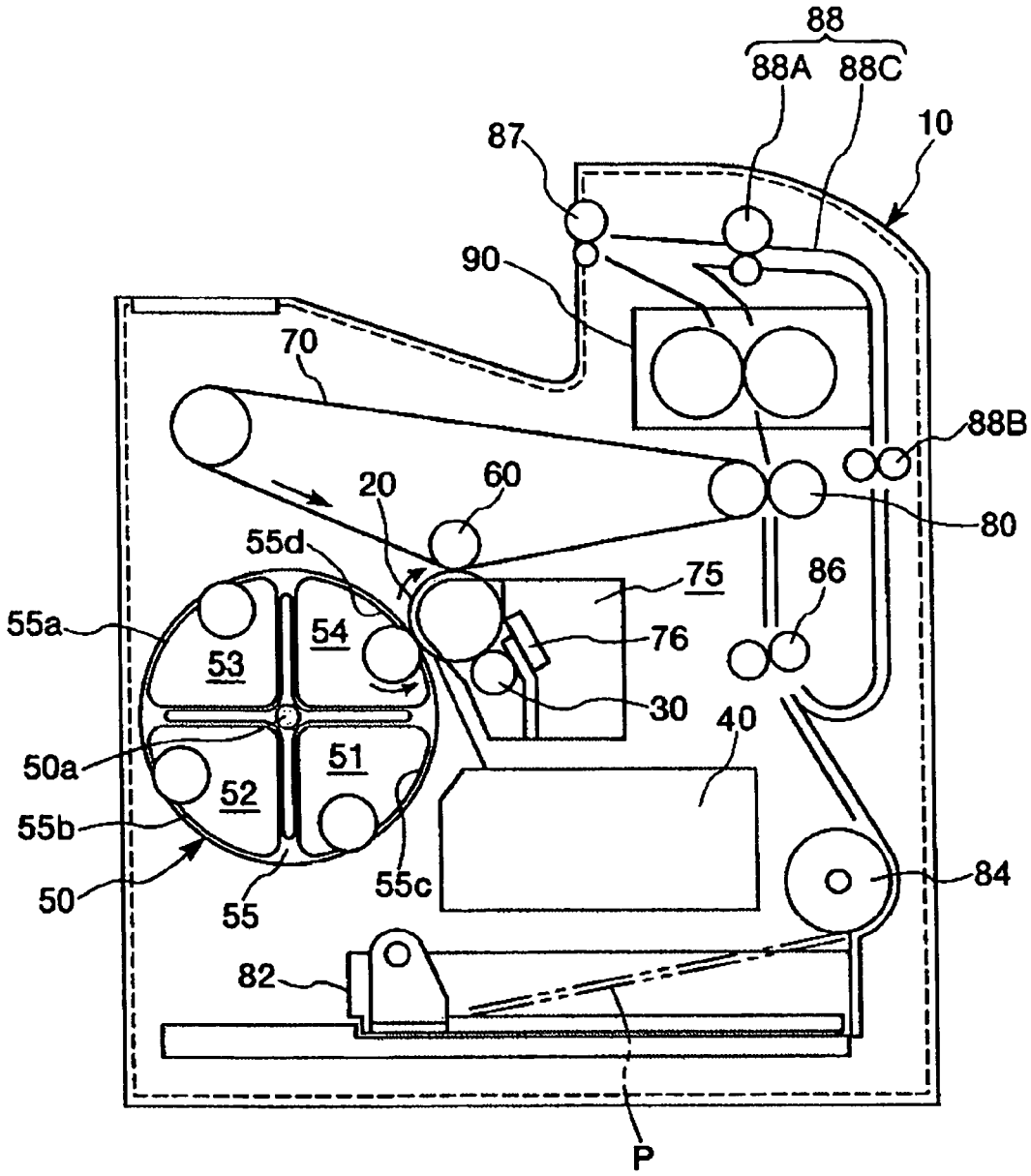
FIG. 1 is a schematic cross-sectional view showing the overall structure of an image forming apparatus according to the present embodiment.
Figure 2:
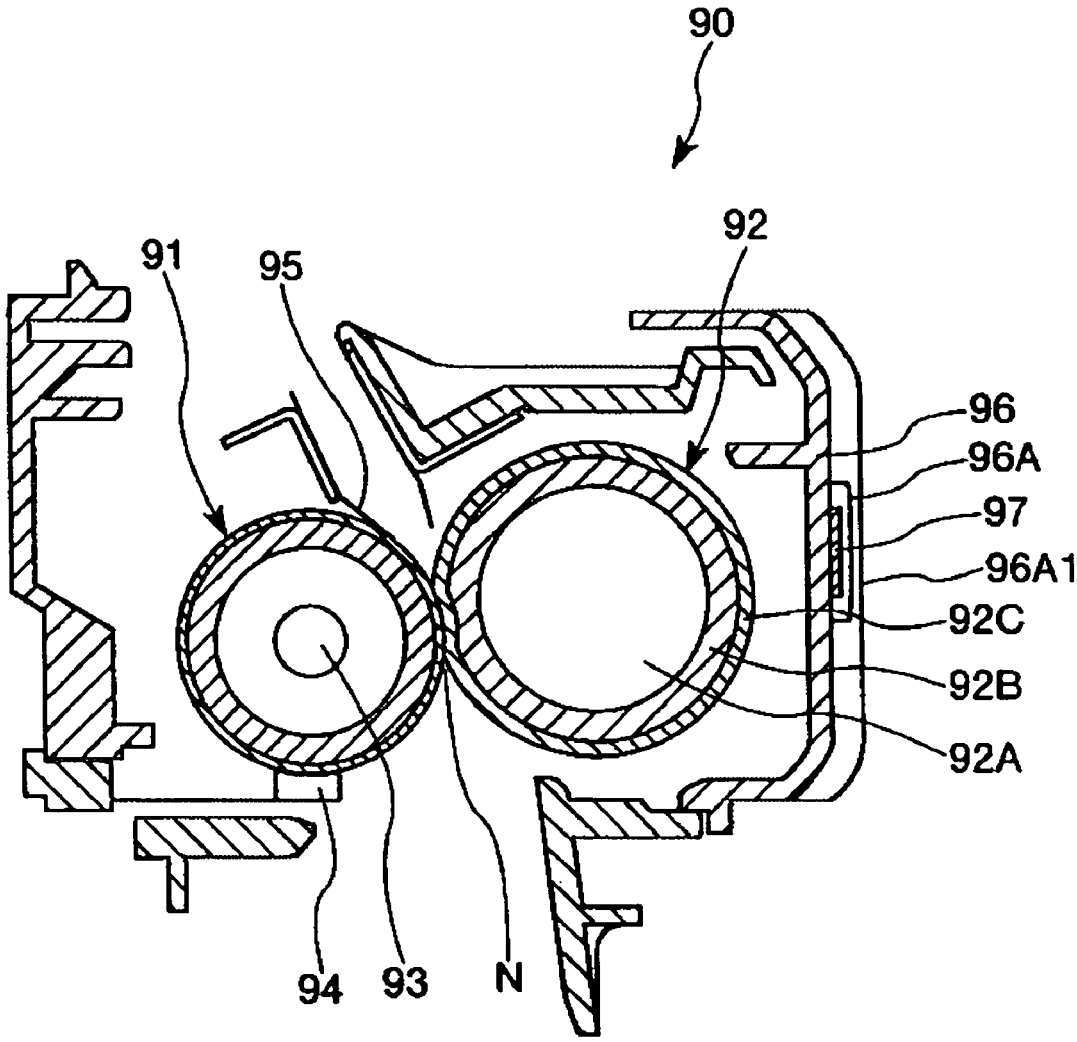
FIG. 2 is a schematic cross-sectional view showing a first embodiment of a fixing unit provided in the image forming apparatus shown in FIG. 1.
Figure 3:
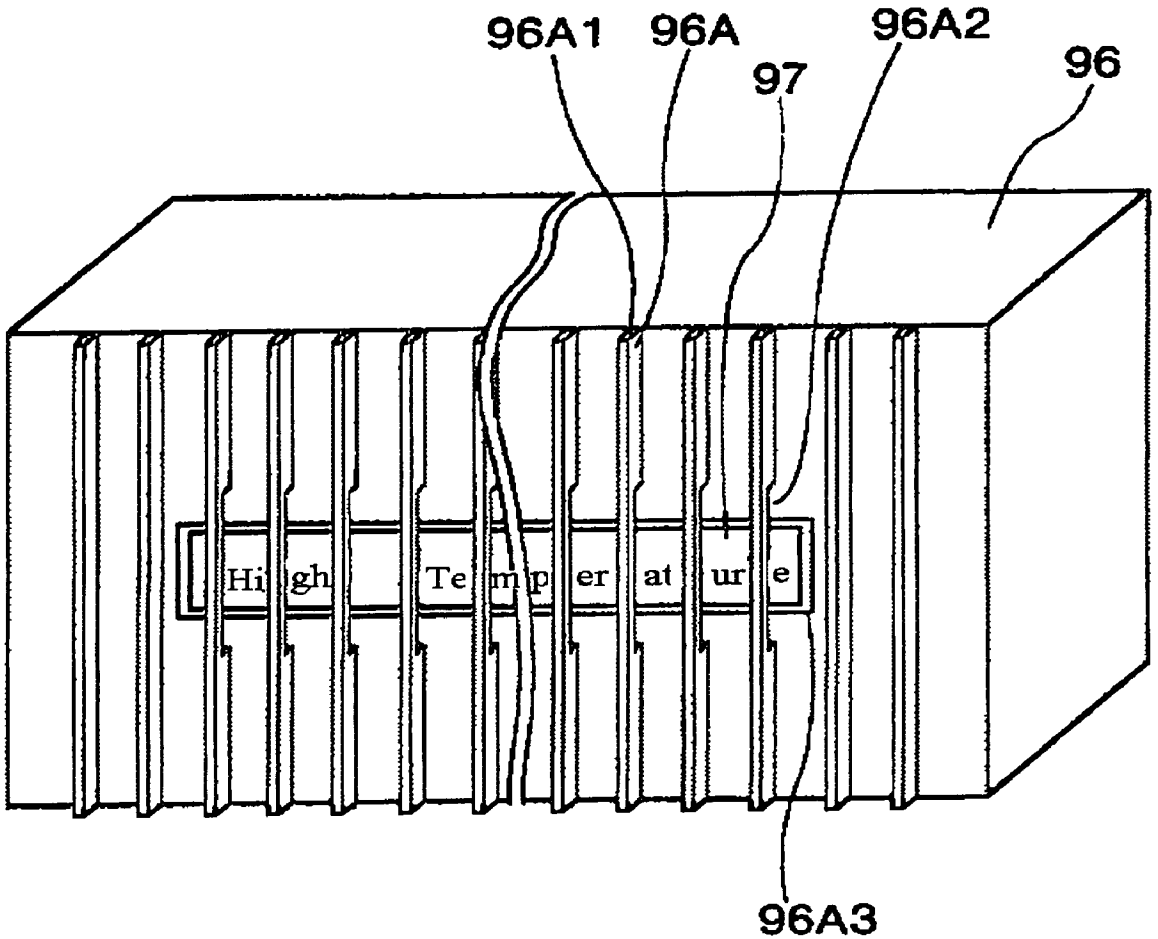
FIG. 3 is an external perspective view showing the rough structure of a housing of the fixing unit shown in FIG. 2.
Figure 4:
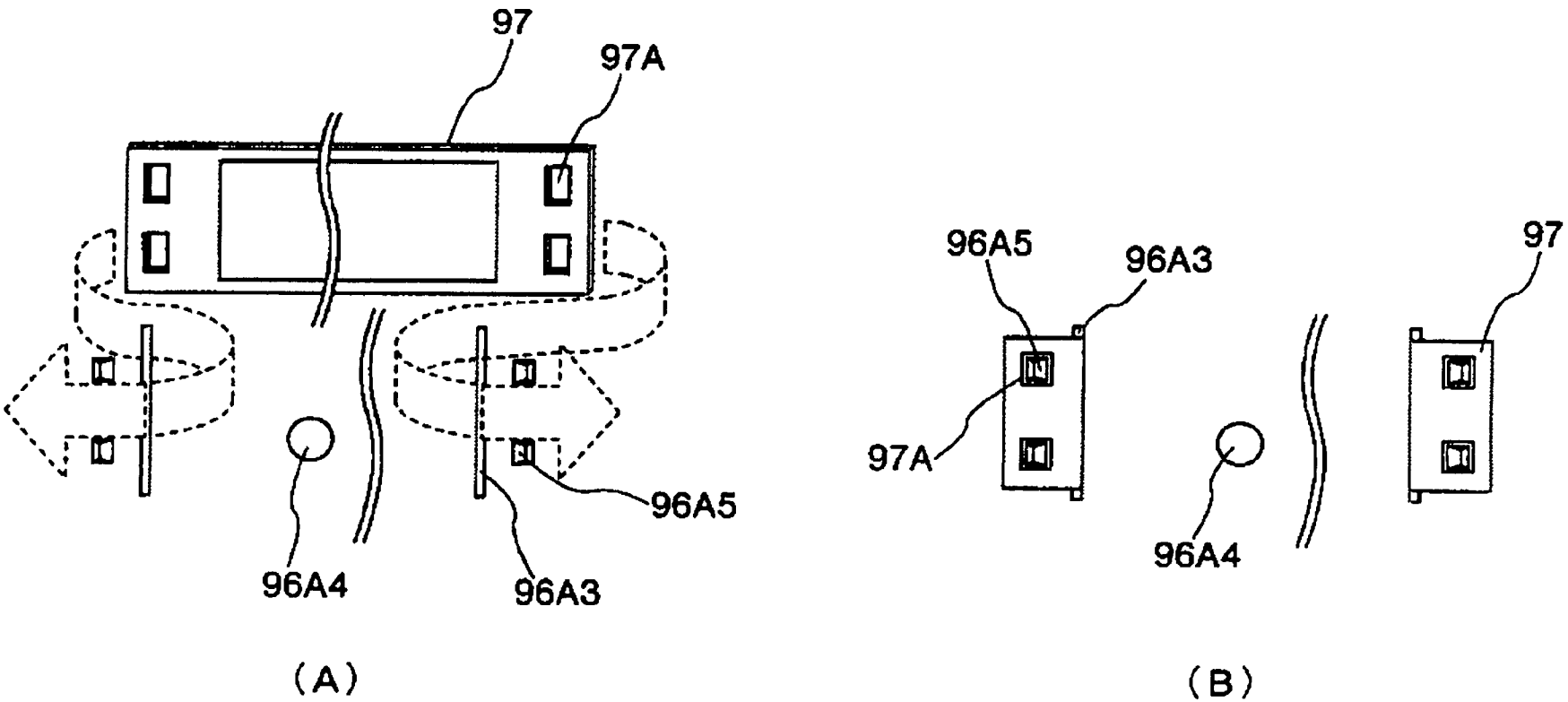
FIG. 4 is an illustration for describing the method for attaching a plate-shaped member to the housing of the fixing unit shown in FIG. 2.
Figure 5:
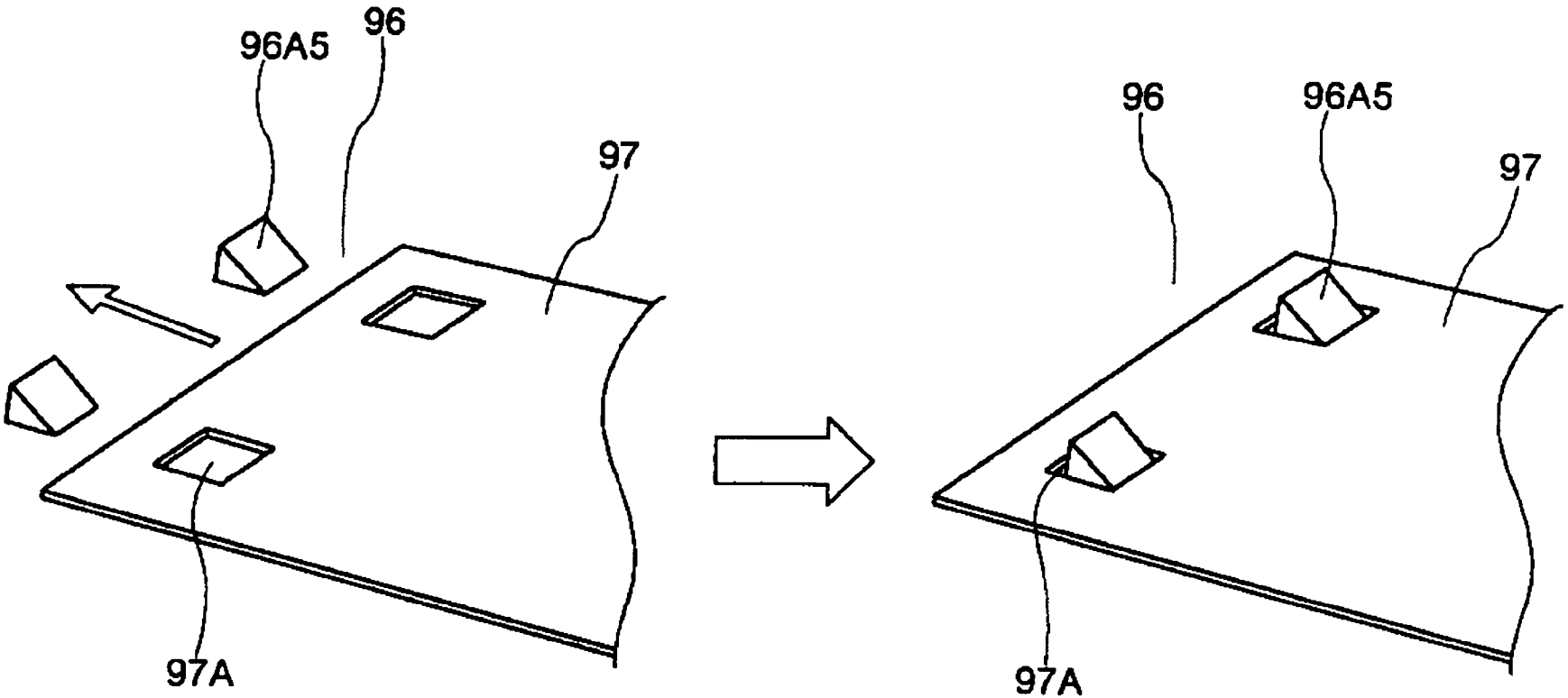
FIG. 5 is an illustration for describing the state that the plate-shaped member is attached to the housing of the fixing unit shown in FIG. 2.
Figure 6:
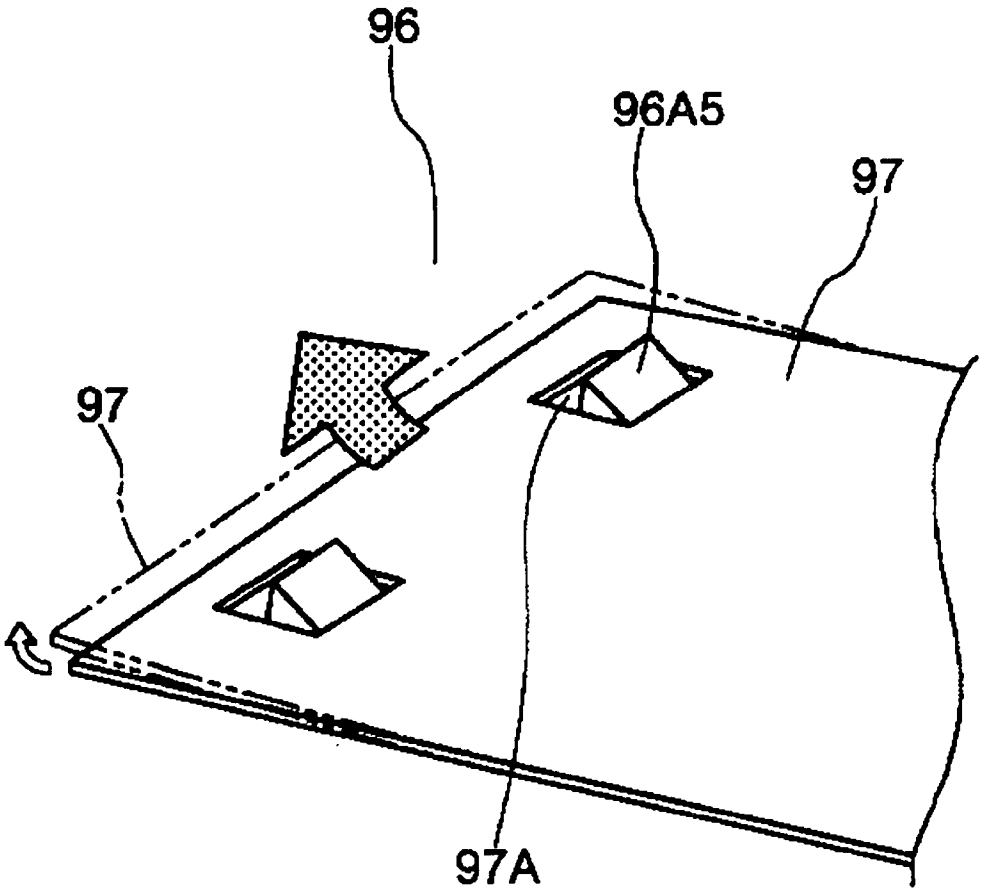
FIG. 6 is an illustration for describing the state at the time of thermal expansion of the plate-shaped member attached to the housing of the fixing unit.

FIG. 1 is a schematic cross-sectional view showing the overall structure of an image forming apparatus according to the present embodiment; FIG. 2 is a schematic cross-sectional view showing a first embodiment of a fixing unit provided in the image forming apparatus shown in FIG. 1; FIG. 3 is an external perspective view showing the rough structure of a housing of the fixing unit shown in FIG. 2; FIG. 4 is an illustration for describing the method for attaching a plate-shaped member to the housing of the fixing unit shown in FIG. 2; FIG. 5 is an illustration for describing the state that the plate-shaped member is attached to the housing of the fixing unit shown in FIG. 2; and FIG. 6 is an illustration for describing the state at the time of thermal expansion of the plate-shaped member attached to the housing of the fixing unit.

As shown in FIG. 1, an image forming apparatus 10 of the present embodiment includes a photosensitive body 20 which carries a latent image and rotates in the direction of the arrow shown in the drawing. The image forming apparatus 10 further includes a charging unit 30, an exposure unit 40, a developing unit 50, a primary transfer unit 60 and a cleaning unit 75, and they are arranged in that order along the rotational direction of the photosensitive body 20. Further, in the lower portion in FIG. 1, the image forming apparatus 10 includes a paper supply tray 82 which holds a recording medium P such as paper or the like. Further, registration rollers 86, a secondary transfer unit 80, a fixing unit 90 and a pair of paper ejection rollers 87 are arranged in that order downstream from the paper supply tray 82 in the conveying direction of the recording medium P. Furthermore, in the case where an image is to be formed on both sides of a recording medium P, the image forming apparatus 10 is provided with a conveying section 88 for the purpose of turning over a recording medium P which has undergone a fixing process on one side by the fixing unit 90 and returning it to the secondary transfer unit 80.

The photosensitive body 20 includes a cylindrical conductive base material (not shown in the drawings) and a photosensitive layer (not shown in the drawings) formed on the outer peripheral surface thereof, and is rotatable around the axis thereof in the direction of the arrow shown in FIG. 1.

The charging unit 30 is a device for uniformly charging the surface of the photosensitive body 20 by corona charging or the like.

The exposure unit 40 is a device which forms an electrostatic latent image on the uniformly charged photosensitive body 20 by irradiating a laser in accordance with image information received from a host computer such as a personal computer or the like not shown in the drawings.

The developing unit 50 includes four developing devices, namely, a black developing device 51, a magenta developing device 52, a cyan developing device 53 and a yellow developing device 54. These developing devices 51, 52, 53, 54 are devices which make the latent image visible as a toner image and are selectively used in accordance with the latent image formed on the photosensitive body 20. The black developing device 51 uses black (K) toner, the magenta developing device 52 uses magenta (M) toner, the cyan developing device 53 uses cyan (C) toner, and the yellow developing device 54 uses yellow (Y) toner to carry out developing.

The YMCK developing unit 50 in the present embodiment is rotatable to make the four developing devices 51, 52, 53, 54 face the photosensitive body 20. Namely, in the YMCK developing unit 50, the four developing devices 51, 52, 53, 54 are held respectively in four holding portions 55*a*, 55*b*, 55*c*, 55*d* of a holding body 55 which is rotatable around a shaft 50*a*. By rotating the holding body 55, the four developing devices 51, 52, 53, 54 can be selectively made to face the photosensitive body 20 while maintaining a relative position relationship.

The primary transfer unit 60 is a device for transferring a monochrome toner image formed on the photosensitive body 20 to an intermediate transfer body 70.

The intermediate transfer body 70 is an endless belt which is driven rotationally at roughly the same circumferential speed as the photosensitive body 20 in the direction of the arrow shown in FIG. 1. A toner image having at least one color of black, magenta cyan and yellow is carried on the intermediate transfer body 70. For example, when forming a full color image, transferring is carried out by sequentially layering toner images having the four colors including black, magenta, cyan and yellow to form a full color toner image.

The secondary transfer unit 80 is a device for transferring monochrome or full color toner images or the like formed on the intermediate transfer body 70 to a recording medium P such as paper, film, cloth or the like.

The fixing unit 90 is an apparatus for fixing the toner image to the recording medium P by fusion to form a permanent image by applying heat and pressure to the recording medium P on which the toner image has been transferred. In this regard, the fixing unit 90 is described in detail later.

The cleaning unit 75 includes a rubber cleaning blade 76 which makes contact with the surface of the photosensitive body 20 between the primary transfer unit 60 and the charging unit 30. The cleaning unit 75 is provided for scrapping off any toner that remains on the photosensitive body 20 by the cleaning blade 76 after the toner image has been transferred onto the intermediate transfer body 70 by the primary transfer unit 60.

The conveying portion 88 is equipped with a pair of conveying rollers 88A, 88B through which is conveyed a recording medium P that has undergone a fixing process on one side by the fixing unit 90, and a conveying route 88C which turns over the recording medium P conveyed by the pair of conveying rollers 88A, 88B and guides it toward the registration rollers 86. In this way, in the case where an image is to be formed on both sides of a recording medium P, the recording medium P that has undergone a fixing process on one side by the fixing unit 90 is turned over and returned to the secondary transfer unit 80.

Next, the operation of the image forming apparatus 10 having the above structure will be described.

First, the photosensitive body 20, the developing rollers (not shown in the drawings) provided in the developing unit 50, and the intermediate transfer body 70 are started to rotate in accordance with instructions from a host computer not shown in the drawings. Then, the photosensitive body 20 is sequentially charged by the charging unit 30 while rotating.

The charged area of the photosensitive body 20 reaches the exposure position according to the rotation of the photosensitive body 20, and a latent image according to first color (e.g., yellow) image information is formed in such area by the exposure unit 40.

The latent image formed on the photosensitive body 20 reaches the developing position according to the rotation of the photosensitive body 20, and developing with yellow toner is carried out by the yellow developing device 54. In this way, a yellow toner image is formed on the photosensitive body 20. At this time, the yellow developing device 54 of the YMCK developing unit 50 faces the photosensitive body 20 at such developing position.

The yellow toner image formed on the photosensitive body 20 reaches the primary transfer position according to the rotation of the photosensitive body 20, and is transferred to the intermediate transfer body 70 by the primary transfer unit 60. At this time, a primary transfer voltage (primary transfer bias) having the opposite polarity as the charge polarity of the toner is applied in the primary transfer unit 60. Further, during this time, the secondary transfer unit 80 is separated from the intermediate transfer body 70.

By repeating the same process described above for the second color, the third color and the fourth color, each color toner image corresponding to each image signal is transferred and layered onto the intermediate transfer body 70. In this way, a full color toner image is formed on the intermediate transfer body 70.

On the other hand, the recording medium P is conveyed from the paper supply tray 82 to the secondary transfer unit 80 by a paper supply roller 84 and the registration rollers 86.

The full color toner image formed on the intermediate transfer body 70 reaches the secondary transfer position according to the rotation of the intermediate transfer body 70, and is transferred to the recording medium P by the secondary transfer unit 80. At this time, the secondary transfer unit 80 applies pressure and a secondary transfer voltage (secondary transfer bias) to the intermediate transfer body 70.

The full color toner image transferred to the recording medium P is fused to the recording medium P by applying heat and pressure by the fixing unit 90. Then, the recording medium P is ejected to the outside of the image forming apparatus 10 by the pair of paper ejection rollers 87.

On the other hand, after the photosensitive body 20 passes the primary transfer position, any toner adhering to the surface thereof is scraped off by the cleaning blade 76 of the cleaning unit 75, and then a charge for forming the next latent image is provided. The scraped off toner is collected in a residue toner collecting portion inside the cleaning unit 75.

In the case where an image is to be formed on both sides of a recording medium P, after the recording medium P which has undergone a fixing process on one side by the fixing unit 90 is held once between the pair of paper ejection rollers 87, the pair of paper ejection rollers 87 is driven in reverse and the pair of conveying rollers 88A, 88B is driven, whereby the recording medium P is turned over as it passes through the conveying path 88 and returned to the secondary transfer unit 80. Then, by carrying out the same operation described above, an image is formed on the other side of the recording medium P.

Fixing Unit

Now, the fixing unit 90 will be described in detail with reference to FIGS. 1 to 3.

As shown in FIG. 2, the fixing unit 90 includes a fixing roller 91 and a pressure roller 92 which are a pair of rotating bodies that are pressed to each other as they rotate, a heater 93 for heating these rollers, a temperature detector 94 for detecting the temperature of the fixing roller 91, a separation member 95 for separating a recording medium from the fixing roller 91 after fixing, a housing 96 which houses the fixing roller 91 and the pressure roller 92, a plate-shaped member 97 for indicating information which can be fastened to and removed from the outer surface of the housing 96, and adjustment means (not shown in the drawing) provided in the housing 96 for adjusting the distance between the axes of the fixing roller 91 and the pressure roller 92.

In the fixing unit 90, a nip N is formed by the fixing roller 91 and the pressure roller 92 which are pressed to each other. A recording medium P carrying an unfixed image is conveyed to the nip N from the bottom in FIG. 2, and then the unfixed image is fixed onto the recording medium by applying heat and pressure to the recording medium. Namely, by passing the recording medium between the fixing roller 91 and the pressure roller 92 which are pressed to each other, and applying heat and pressure to the recording medium, the unfixed image is fixed onto the recording medium. In the present embodiment, the recording medium conveyed to the nip N carries an unfixed image on the fixing roller 91 side thereof.

The fixing roller 91 has a cylindrical shape and is rotatable around the axis thereof. Further, the heater 93 is arranged in the space inside the fixing roller 91 so that the fixing roller 91 is heated by the heater 93.

The temperature detector 94 for detecting the temperature of the fixing roller 91 is a thermistor, for example, and is provided near the circumferential surface of the fixing roller 91. The operation of the heater 93 is controlled by control means not shown in the drawings based on the temperature detected by the temperature detector 94.

The separation member 95 for separating a recording medium from the fixing roller 91 after fixing is provided in contact with or near the circumferential surface of the fixing roller 91. The separation member 95 is provided for separating the recording medium that has passed through the nip N from the fixing roller 91 to carry it to a proper position (outside the fixing unit 90).

The pressure roller 92 has a cylindrical shape and is rotatable around the axis thereof. Further, the pressure roller 92 is pressed against the fixing roller 91.

As shown in FIG. 1, a part of the surface of the housing 96 which houses the fixing roller 91 and the pressure roller 92 forms a guide surface for a recording medium P in the conveying route 88.

Namely, as shown in FIG. 2 and FIG. 3, the housing 96 includes a plurality of rib-shaped portions 96A which are integrally formed on the outer surface of the housing 96 so as to protrude therefrom and extend along the conveying direction of the recording medium P. Further, these rib-shaped portions 96A are arranged with a mutual spacing on the outer surface of the housing 96 in a direction orthogonal to the conveying direction of the recording medium P so that the ridge surfaces of the rib-shaped portions 96A form a guide surface 96A1 for guiding the recording medium P.

Because the rib-shaped portions 96A have the above configurations to form the guide surface 96A1 as described above, it is possible to reduce the contact area between the recording medium P and the housing 96, so that the recording medium P can be guided smoothly.

Further, as shown in FIG. 3, predetermined rib-shaped portions 96A in all the rib-shaped portions 96A which are other than the rib-shaped portions 96A located at the opposite sides are respectively formed with substantially rectangular notches 96A2 in the forms of linear openings at the side of the outer surface of the housing 96. These notches form an elongated space 96A2 extending in a direction orthogonal to the conveying direction of the recording medium P. The plate-shaped member described below is adapted to be inserted into the elongated space.

Further, in the outer surface of the housing 96, two slits 96A3 in the forms of linear openings are formed at positions outside the opposite sides of the elongated space 96A2. These slits extend roughly parallel to the rib-shaped portions 96A. Furthermore, in the outer surface of the housing 96, an opening 96A4 for accessing the adjustment means (not shown in the drawings) described above is formed between the two slits 96A3.

In addition, protrusions 96A5 are formed on the rear side of the outer surface of the housing 96 at positions more to the outside than the slits 96A3, respectively.

The plate-shaped member 97 is formed from a flexible material, and indicates information such as a high temperature warning, an operation method or the like on the outer surface thereof.

The plate-shaped member 97 is attached onto the outer surface of the housing 96 so that the information indicating side faces the outside. Namely, the plate-shaped member 97 is attached onto the housing 96 in a state that the side thereof opposite the information indicating side is in contact with the outer surface of the housing 96.

In more details, the plate-shaped member 97 is held on the outer surface of the housing 96 by inserting the opposite sides thereof into the slits 96A3, respectively, so as to be positioned inside the elongated space 96A2. Further, holes 97A formed in the opposite end portions of the plate-shaped member 97 are engaged with the protrusions 96A6, respectively. By engaging the protrusions 96A5 of the housing 96 with the holes 97A, the plate-shaped member 97 is securedly attached to the outer surface of the housing 96.

At the time when the plate-shaped member 97 is attached to the housing 96, the plate-shaped member 97 is temporarily bent to insert the opposite end portions of the plate-shaped member 97 in the slits 96A3 inside the elongated space 96A2 as shown in FIG. 4(A), and the holes 97A of the plate-shaped member 97 are made to engage with the protrusions 96A5 of the housing 96 as shown in FIG. 4(B) and FIG. 5.

In this way, the plate-shaped member 97 is physically held to the housing 96 in a manner that enables the plate-shaped member 97 to be removed from the housing 96. Namely, the fixing unit 90 includes holding means for physically holding the plate-shaped member 97 onto the outer surface of the housing 96 in a manner that enables the plate-shaped member 97 to be removed from the housing 96 when necessary. Specifically, the elongated space (that is, the notches) 96A2, the slits 96A3 and the opposite portions of the plate-shaped member 97 which engage with the slits 96A3 form the holding means of the present invention. Further, the protrusions 96A5 of the housing 96 and the holes 97A of the plate-shaped member 97 form the engaging portions of the holding means.

In this way, while information can be indicated to the outside of the fixing unit 90 by the plate-shaped member 97 when necessary, it is possible to remove the plate-shaped member 97 from the housing 96 with relative ease when carrying out operations such as recycling operations or the like, and this makes it possible to reduce the burden of the operations.

In particular, because the slits (linear openings) 96A3 and the portions of the plate-shaped member 97 which are inserted into the slits 96A3 constitute the holding means, the plate-shaped member 97 can be held on the outer surface of the housing 96 by a simple inexpensive structure without the use of fasteners such as machine screws or the like. Further, at any desired time, the plate-shaped member 97 can be removed from the housing 96 easily as compared to the case where fasteners are used. As a result, the burden of the recycling operation can be further reduced.

Further, because the housing 96 is reinforced by the rib-shaped portions 96A and the notches (linear openings) 96A2 formed in the rib-shaped portions 96A and the portions of the plate-shaped member 97 which are held by the notches 96A2 constitute the holding means of the present invention, the strength of the housing 96 is improved as well as the burden of operations such as recycling operation can be reduced while the information can be indicated to the outside of the fixing unit 90 by the plate-shaped member 97 when necessary. Further, because the plate-shaped member 97 is protected by the protrusions 96A, it is possible to more reliably prevent the accidental removal of the plate-shaped member 97 from the housing 96.

Further, because the ridge surfaces of the protrusions 96A form a guide surface 96A1, the outer surface of the housing 96 can be utilized effectively and this also makes it possible to reduce the manufacturing costs of the fixing unit 90 and the image forming apparatus 10 while information can be indicated to the outside of the fixing unit 90 when necessary.

Further, because the plate-shaped member 97 held by the notches 62A2 is positioned more toward the base end side of the protrusions 96A than the guide surface 96A1, the recording medium guided by the guide surface 96A1 is prevented from catching on the plate-shaped member 97, and the guiding of the recording medium by the guide surface 96A1 can be carried out smoothly. As a result, it is possible to prevent the recording medium from jamming near the guide surface 96A1.

Further, because the protrusions 96A5 of the housing 96 and the holes 97A of the plate-shaped member 97 form engaging portions, the plate-shaped member 97 can be removed from the housing 96 easily when necessary such as at the maintenance time or the like, and it is possible to more reliably prevent the accidental removal of the plate-shaped member 97 from the housing 96.

Figure 7:
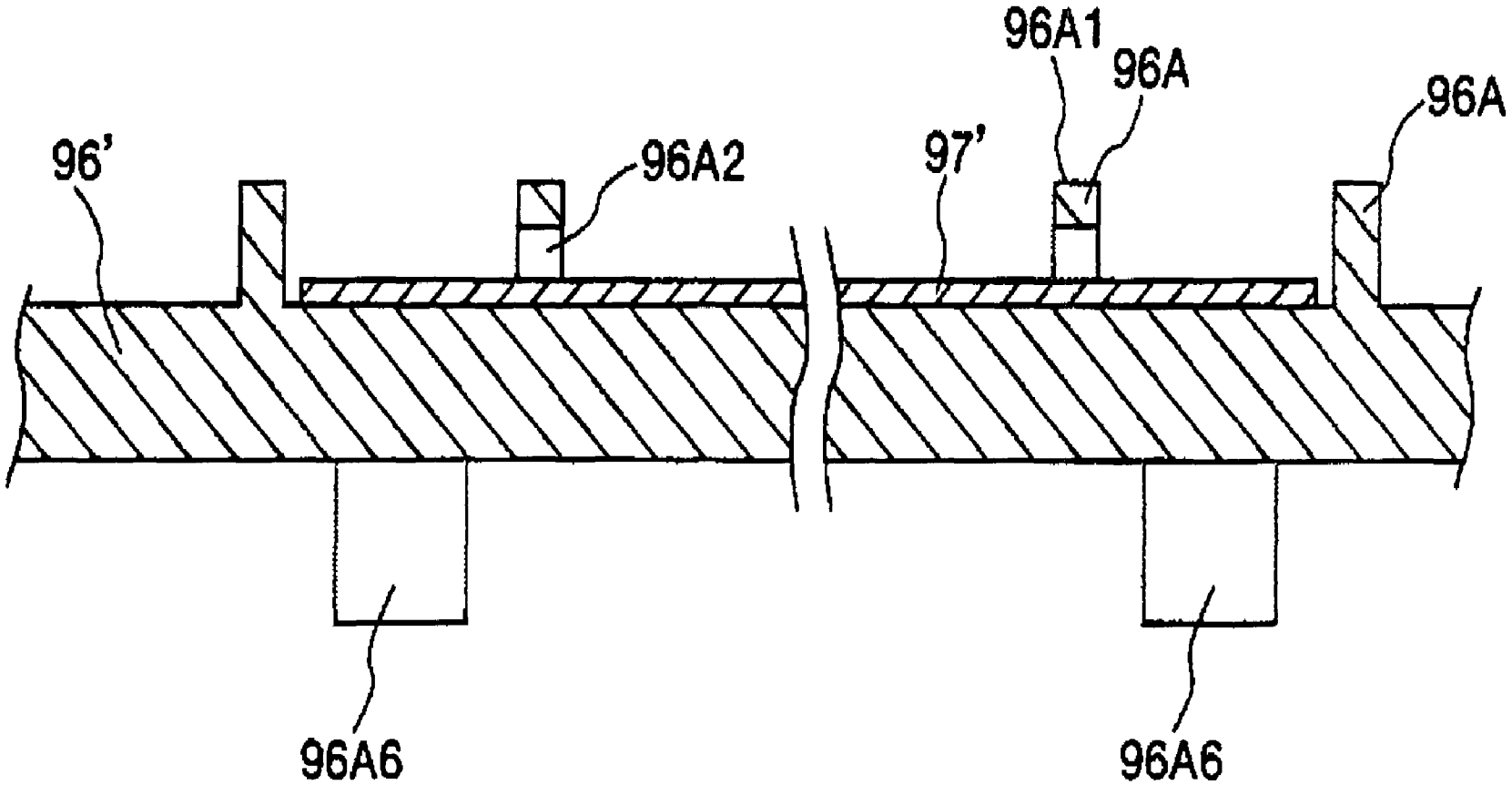
FIG. 7 is a cross-sectional view of a part of a fixing unit of the second embodiment which shows the rough structure of a housing of the fixing unit and a plate-shaped member provided on the housing.

Further, as shown in FIG. 3 and FIG. 7, the engaging portions described above allows relative movement of the plate-shaped member 97 and the housing 96 for absorbing thermal expansion of the plate-shaped member 97. In this way, the plate-shaped member 97 can be removed from the housing 96 easily when necessary such as at the maintenance time or the like, and it is possible to more reliably prevent the accidental removal of the plate-shaped member 97 from the housing 96.

Further, as shown in FIG. 4, the plate-shaped member 97 covers the opening 96A4 of the housing 96. In this way, while the user can be prevented from accidentally adjusting the distance between the axes of the fixing roller 91 and the pressure roller 92, the plate-shaped member 97 can be removed from the housing 96 easily to access the adjustment means (not shown in the drawings) described above to carry out adjustments when necessary such as at the time of maintenance or the like by a serviceman. Further, in addition to giving access to the adjusting means for adjusting the distance between the axes of the fixing roller 91 and the pressure roller 92 from the outside of the housing 96, the opening 96A4 may also make it possible to access means for adjusting the position of components arranged in contact with or near the fixing roller 91 or the pressure roller 92. Examples of such components include the temperature detector 94, the separation member 95, a cleaner, a paper sensor and the like.

There is no particular limitation to the construction material of the plate-shaped member 97 described above so long as the plate-shaped member 97 is removable from the housing 96, but preferably such material has elasticity. In this way, the plate-shaped member 97 can be removed from the housing 96 easily when necessary such as at the maintenance time or the like, and it is possible to more reliably prevent the accidental removal of the plate-shaped member 97 from the housing 96.

As described above, the fixing unit 90 and the image forming apparatus 10 of the present embodiment can indicate information to the outside of the fixing unit 90 when necessary, and make it possible to reduce the burden of the recycling operation.

Second Embodiment

Next, the second embodiment of the present invention will be described with reference to FIG. 7. The description given below will focus on the differences with the first embodiment, and therefore a description of similar items is omitted.

FIG. 7 is a cross-sectional view of a fixing unit of the second embodiment which shows the rough structure of a housing and a plate-shaped member provided on the fixing unit.

Except for the fact that the housing and the plate-shaped member have different structures, the fixing unit of the second embodiment is the same as the fixing unit of the first embodiment.

As shown in FIG. 7, a housing 96' provided in the fixing unit of the present embodiment is provided with magnetic force generating portions 96A6 which generate a magnetic force on the rear surface in the area corresponding to the plurality of notches (linear openings) 96A2, and a plate-shaped member 97' constructed from a material that attracts magnetic force is held on such surface by the magnetic force from the magnetic force generating portions 96A6.

Namely, the magnetic force generating portions 96A6 and the plate-shaped member 97' form the holding means of the present invention, and this makes it possible to physically attach the plate-shaped member 97' to the housing 96' in a manner that enables the plate-shaped member 97' to be removed from the housing 96'. In this way, the plate-shaped member 97' can be removed from the housing 96' easily when necessary such as at a time of the maintenance or the like, and it is possible to more reliably prevent the accidental removal of the plate-shaped member 97' from the housing 96'.

Hereinbelow, third to fifth embodiments according to the present invention will be described.

These embodiments are directed to a fixing unit and an image forming apparatus equipped with the fixing unit which can prevent a guide surface for a recording medium which is formed on the outer surface of a housing of the fixing unit from being damaged when the fixing unit is removed from the image forming apparatus.

In more details, these embodiments are made for solving the following problem.

Namely, in general, a part of the outer surface of a housing of a fixing unit provided in an image forming apparatus is used as a guide surface for guiding a recording medium when toner images are to be formed on both the sides of the recording medium. Specifically, the outer surface of the housing is used as a guide surface when a recording medium in which a toner image has been already formed on one side thereof and a fixing treatment has already been carried out is retuned to the transfer section for forming a toner image on the opposite side of the recording medium. One example of such an image forming apparatus is disclosed in JP-A 1-274161.

The fixing unit includes a pair of rollers provided inside the housing thereof, and such a fixing unit is removably provided in the image forming apparatus so that the old fixing unit can be replaced with a new fixing unit when the life thereof has been expired.

In such an image forming apparatus, when replacing the fixing unit, there is a case that the guide surface of the housing collides against something and the guide surface thereof is damaged. When the guide surface is damaged, it is impossible to smoothly guide the recording medium and thus jamming of the recording medium is likely to occur in the image forming apparatus.

These embodiments are made in order to solve the above problem, and thus its object is to provide a fixing unit having a housing having an outer surface used as a recording medium guiding surface and an image forming apparatus equipped with the fixing unit, wherein it is possible to prevent the guide surface from being damaged when the fixing unit is removed from the image forming apparatus.

Third Embodiment

Figure 8:
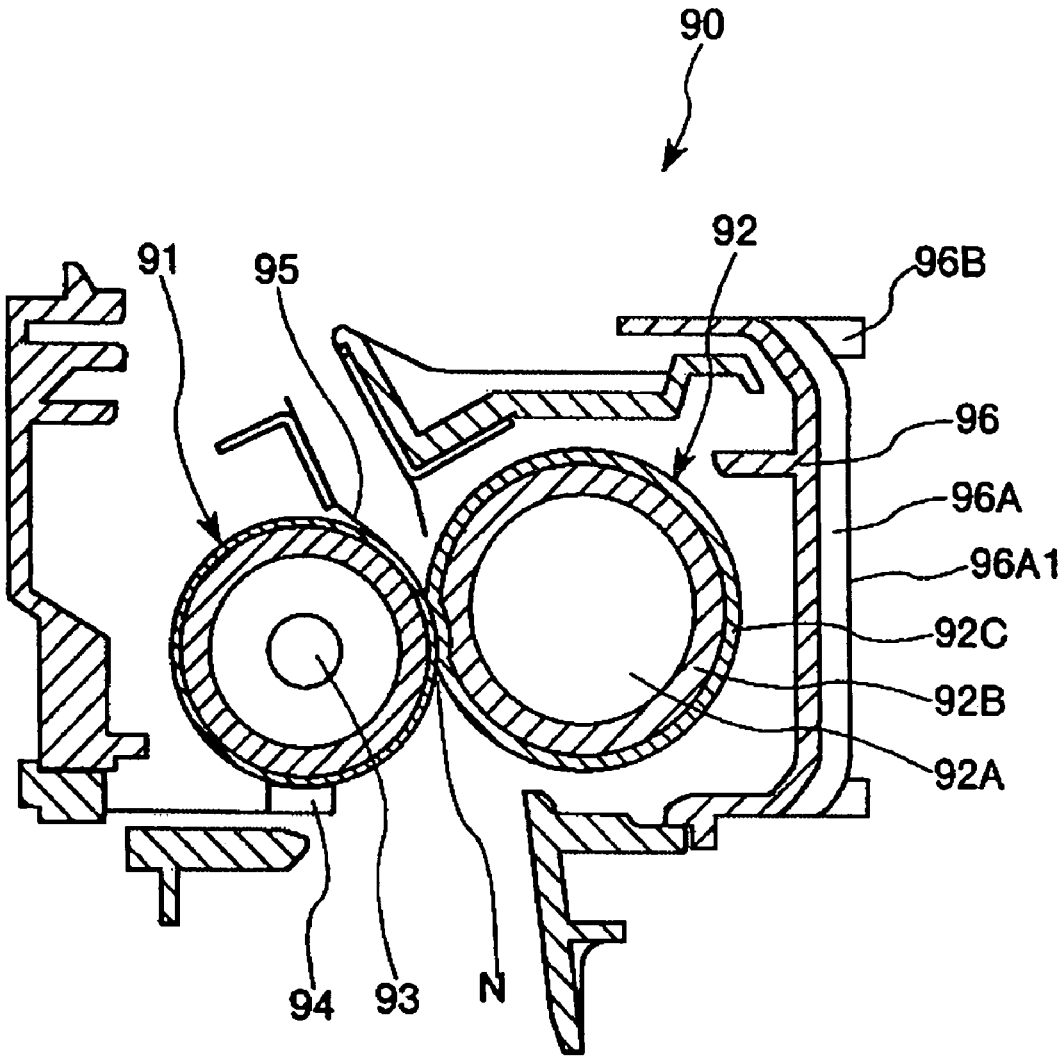
FIG. 8 is a schematic cross-sectional view showing a third embodiment of a fixing unit provided in the image forming apparatus shown in FIG. 1.

As shown in FIG. 8, a part of the outer surface of the housing 96 which houses the fixing roller 91 and the pressure roller 92 forms a guide surface for a recording medium P in the conveying route 88.

Figure 9:
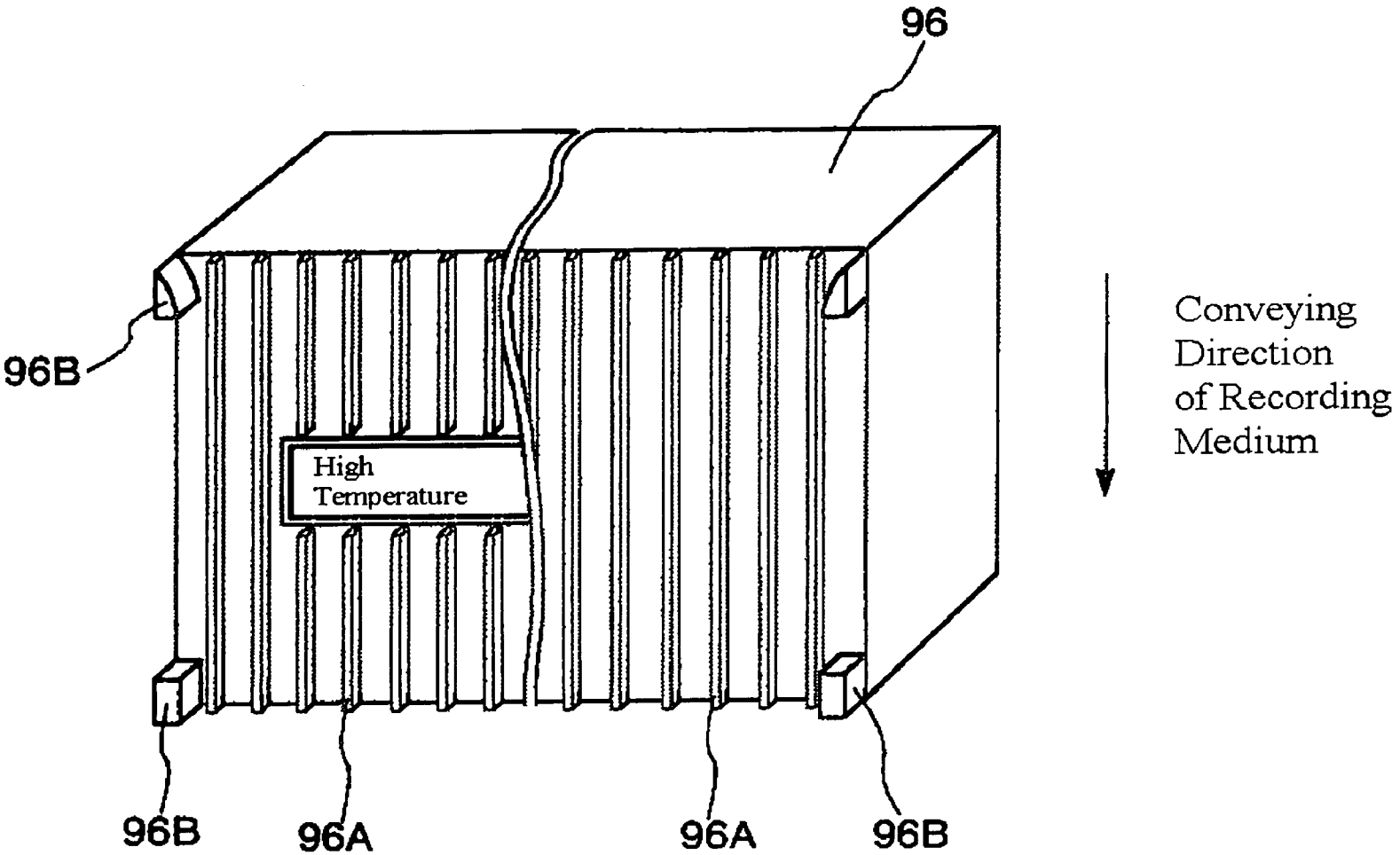
FIG. 9 is an external perspective view showing the rough structure of a housing of the third embodiment of the fixing unit shown in FIG. 8.

Namely, as shown in FIG. 8 and FIG. 9, the housing 96 includes a plurality of rib-shaped guide portions 96A which protrude from the outer surface of the housing 96, and protrusions 96B which protrude from the outer surface of the housing 96 to the outside of the housing 96 beyond the rib-shaped guide portions 96A.

A ridge surface of each rib-shaped guide portion 96A forms a guide surface for the recording medium P and extends along the conveying direction of the recording medium P. Namely, each rib-shaped guide portion 96A is in the form of a rib, and the ridge surfaces of the rib-shaped guide portions form a guide surface 96A1 for the recording medium P. Further, the plurality of rib-shaped guide portions 96A are arranged with a mutual spacing along the outer surface of the housing 96 in a direction orthogonal to the conveying direction of the recording medium P.

Because the rib-shaped guide portions 96A that form such guide surface 96A1 having this shape make it possible to reduce the contact area between the recording medium P and the guide surface 96A1, the recording medium P can be guided smoothly by the guide surface 96A1. Further, because the strength of such guide surface 96A1 (that is, each rib-shaped guide portion) is relatively low, the effect of the present invention becomes more noticeable by the provision of the protrusions 96B.

The protrusions 96B are provided at four outside positions in the cross direction of the plurality of rib-shaped guide portions 96A, and protrude beyond the ridge surfaces (tip portions) of the rib-shaped guide portions 96A, namely, the guide surface 96A1. In this way, when the fixing unit 90 is installed in or removed from the image forming apparatus 10, the protrusions 96B make contact with other objects to protect the guide surface 96A1. Therefore, it is possible to prevent damage to the guide surface 96A1. In particular, when the fixing unit 90 is removed from the image forming apparatus 10 and placed on a flat surface such as a table or a floor or the like, the guide surface 96A1 is kept in a state separated from such flat surface due to the protrusions 96B, and this makes it possible to prevent damage to the guide surface 96A1.

In particular, in the present embodiment, because the protrusions 96B are positioned to the outside in the cross direction of the conveying area of the recording medium P guided by the guide surface 96A1, such a housing 96 can be made with a relatively simple structure. As a result, when the fixing unit 90 is installed in the image forming apparatus 10, it is possible to prevent damage to the guide surface 96A1 without hindering the guiding of the recording medium P by the guide surface 96A1.

Further, the protrusions 96B are provided at both sides in the cross direction of the conveying area of the recording medium P guided by the guide surface 96A1 so that the movement of the recording medium P in the cross direction thereof is restricted. With this result, in addition to being able to prevent damage to the guide surface 96A1, because there is no need to provide a separate member for restricting movement of the recording medium P in the cross direction thereof, it is possible to lower the manufacturing cost and reduce the size of the fixing unit 90.

Further, the upstream end portions of the protrusions 96B in the conveying direction of the recording medium P, namely, the two upper protrusions 96B in the four protrusions 96B shown in FIG. 2 and FIG. 3 are constructed with tapered shapes so that the distance between these two protrusions on both sides gradually increases from the downstream side to the upstream side as shown in FIG. 3. In this way, the recording medium P can be introduced smoothly by the guide surface 96A1 while restricting movement of the recording medium P in the cross direction thereof.

As described above, the fixing unit 90 of the present embodiment and the image forming apparatus 10 equipped with the fixing unit 90 make it possible to prevent damage to the guide surface 96A1 formed by the ridge surfaces of the rib-shaped guide portions 96A when the fixing unit 90 is installed in or removed from the image forming apparatus 10.

Fourth Embodiment

The fourth embodiment of the present invention will be described with reference to FIG. 10. The description given below will focus on the difference with the third embodiment, and therefore a description of similar components or elements is omitted.

Figure 10:
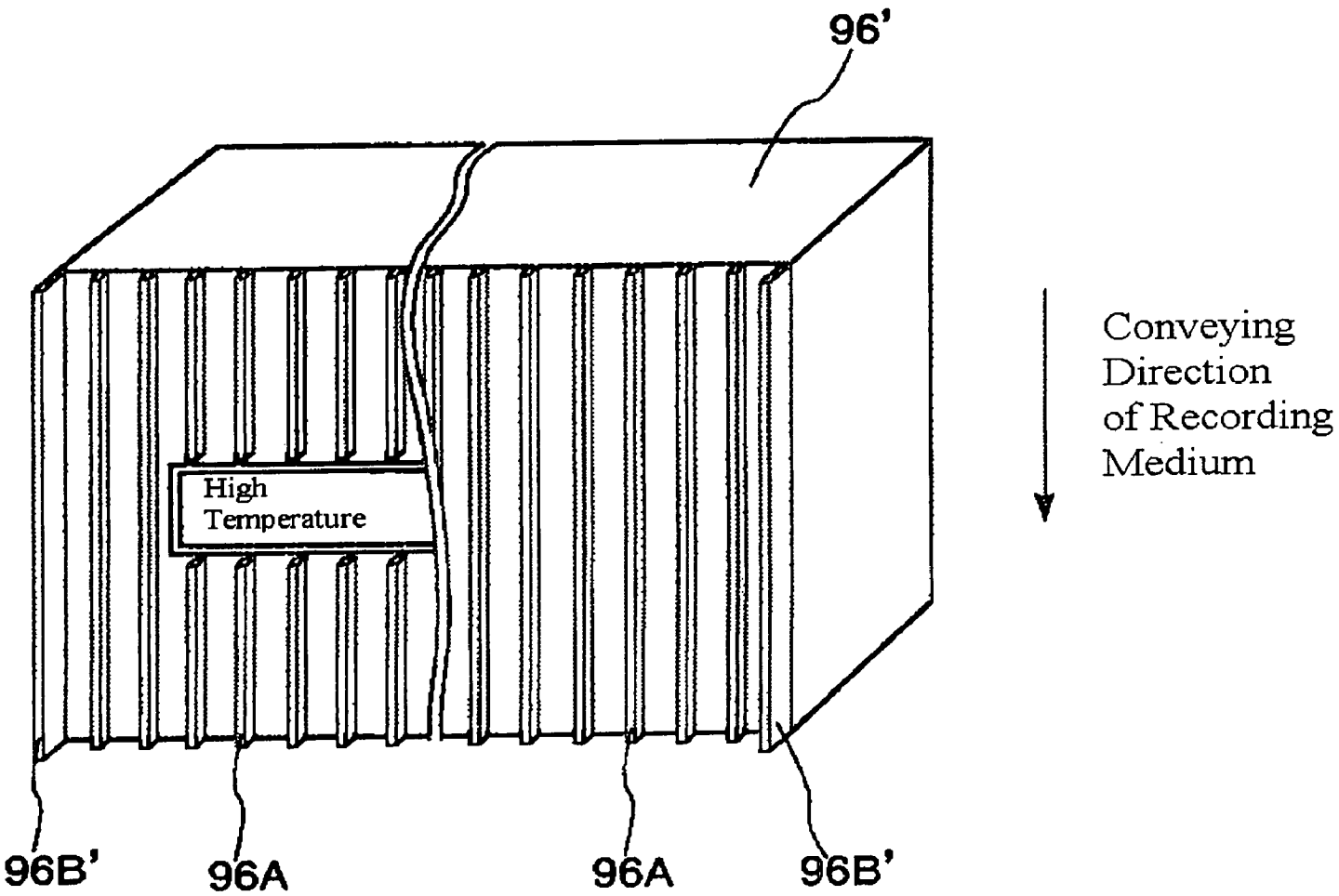
FIG. 10 is an external perspective view showing the rough structure of a housing of a fourth embodiment of the fixing unit.

FIG. 10 is a perspective view showing the rough structure of a housing provided in the fixing unit of the present embodiment.

Except for the fact that the housing has a different structure, the fixing unit of the present embodiment is the same as the fixing unit of the third embodiment.

Namely, as shown in FIG. 10, a housing 96' provided in the fixing unit of the present embodiment includes rib-shaped protrusions 96B' which protrude from the outer surface of the housing 96 to the outside of the housing 96 beyond the rib-shaped guide portions 96A. The rib-shaped protrusions 96B' are also provided at the outside in the cross direction of the recording medium P guided by the plurality of rib-shaped guide portions 96A. Further, the rib-shaped protrusions 96B' protrude beyond the ridge surfaces of the rib-shaped guide portions 96A, namely, the guide surface 96A1. Therefore, when the fixing unit 90 is installed in or removed from the image forming apparatus 10, the rib-shaped protrusions 96B' make contact with other objects to protect the guide surface 96A1, and thus it is possible to prevent damage to the guide surface 96A1.

In particular, the rib-shaped protrusions 96B' are formed over roughly the entire region in the conveying direction of the conveying area of the recording medium P guided by the guide surface 96A1. Namely, the rib-shaped protrusions 96B' have rib shapes similar to the rib-shaped guide portions 96A.

In this way, in addition to more reliably preventing damage to the guide surface 96A1, movement of the recording medium P in the cross direction thereof is restricted more reliably. Further, this also makes it possible to prevent the recording medium P from jamming in the conveying route 88.

Fifth Embodiment

Figure 11:
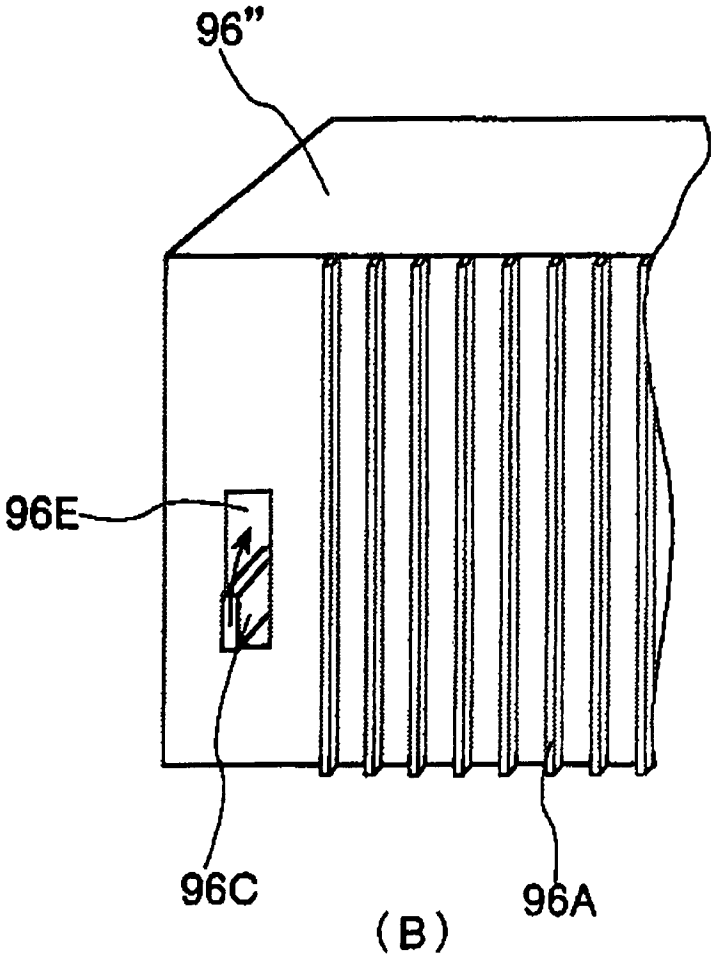
FIG. 11 is an external perspective view showing the rough structure of a housing of a fifth embodiment of the fixing unit.
Figure 11:
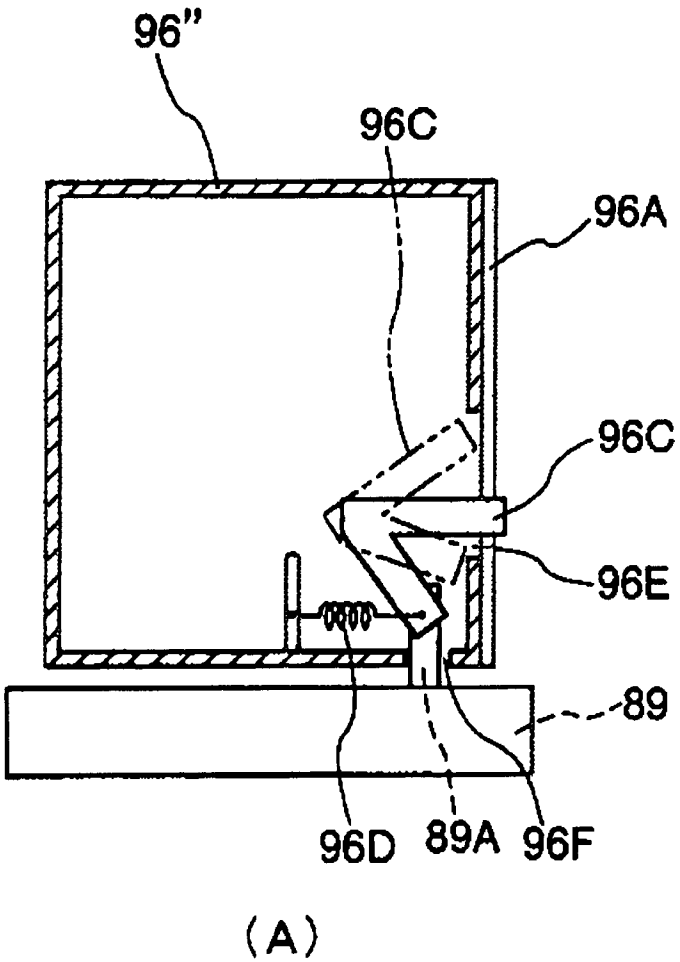

The fifth embodiment of the present invention will be described with reference to FIG. 11. The description given below will focus on the difference with the third embodiment, and therefore a description of similar components or elements is omitted.

FIG. 11(A) is a cross-sectional view showing the rough structure of a housing provided in the fixing unit of the present embodiment, and FIG. 5(B) is a perspective view showing the rough structure of this housing.

Except for the fact that the housing has a different structure, the fixing unit of the present embodiment is the same as the fixing unit of the third embodiment.

A housing 96" provided in the fixing unit of the present embodiment is equipped with a roughly V-shaped pivot member 96C which can freely pivot on the outer surface of the housing 96" at the outside in the cross direction of the recording medium P guided by the plurality of rib-shaped guide portions 96A.

One end of the pivot member 96C is biased in the opposite direction of the arrow in FIG. 5(A) by a biasing means 96D such as a spring or the like.

When the fixing unit 90 is removed from the image forming apparatus 10, the other end of the pivot member 96C protrudes from an opening 96E provided in the housing 96" beyond the rib-shaped guide portions 96A by the biasing force of the biasing means 96D as shown by the solid line in FIG. 5(A) and by FIG. 5(B). Namely, when the fixing unit 90 is removed from the image forming apparatus 10, the other end of the pivot member 96C forms a protrusion.

On the other hand, when the fixing unit 90 is installed in the image forming apparatus 10, a rod 89A formed on an engagement portion 89 of the image forming apparatus 10 which engages with the fixing unit 90 passes through an opening 96F provided in the housing 96" and pivots the pivot member 96C against the biasing force of the biasing means 96D. In this way, as shown by the dashed lines in FIG. 5(A), the other end of the pivot member 96C is housed inside the housing 96".

Accordingly, the pivot member 96C forms a protrusion which protrudes beyond the guide surface 96A1 of the rib-shaped guide portions 96A only at the time when the fixing unit 90 is in a removed state from the image forming apparatus 10. In this way, it is possible to prevent damage to the guide surface 96A1 without increasing the provision space of the fixing unit 90 inside the image forming apparatus 10.

The features of the third to fifth embodiments will be summarized as follows.

(1) A fixing unit which is used by being removably provided in an image forming apparatus which forms an image on a recording medium through a sequential image forming processes, the fixing unit being provided for fixing a toner image onto a recording medium by passing the recording medium which carries an unfixed image between a pair of rollers which are rotated with being pressed to each other to apply heat and pressure to the recording medium thereby fixing the unfixed image onto the recording medium, the fixing unit comprising:

a housing in which the pair of rollers are provided, the housing having an outer surface, and at least a part of the outer surface forming a guide surface for the recording medium; and at least one protrusion which protrudes beyond the guide surface.

(2) The fixing unit as described in the above-described item (1), wherein the protrusions are positioned outside the conveying region of the recording medium to be guided by the guide surface in the cross direction of the recording medium.

(3) The fixing unit as described in the above-described item (2), wherein the protrusions are provided at the both sides of the conveying region for restricting the movement of the recording medium in the cross direction thereof.

(4) The fixing unit as described in the above-described item (3), wherein the end surfaces of the protrusions that face the conveying region are formed so that the distance between the protrusions gradually increase from the downstream side in the conveying direction of the recording medium toward the upstream side thereof.

(5) The fixing unit as described in the above-described item (1), wherein the protrusions are provided over roughly the entire region in the conveying direction of the conveying area of the recording medium guided by the guide surface.

(6) The fixing unit as described in the above-described item (1), wherein the protrusion is constructed so that the protrusion protrudes from the outer surface of the housing only when the fixing unit is removed from the image forming apparatus.

(7) The fixing unit as described in the above-described item (1), wherein the housing is formed with rib-shaped guide portions which extend in the guiding direction of the recording medium and protrude from the outer surface of the housing, and ridge surfaces of these rib-shaped guide portions form the guide surface.

(8) An image forming apparatus equipped with the fixing unit as described any one of the items (1) to (7).

The present invention was described based on the preferred embodiments given above, but the present invention is not limited to these embodiments.

For example, each component or element forming the fixing unit and the image forming apparatus of the present invention may be replaced with any other component or element exhibiting the same function, or other structures may be added thereto.

Further, the holding means for physically holding the plate-shaped member 97 to the housing 96 in a removable manner is not limited to those described in the embodiments. For example, so long as the plate-shaped member 97 can be removed from the housing 96, holding means may be constructed from fasteners such as machine screws or the like which removably fix the plate-shaped member 97 to the housing 96.

Further, in the case where the engaging portions are constructed from the holes and the protrusions as described above, either the housing or the plate-shaped member may be provided with holes, while the other is provided with protrusions which engage with such holes.

Furthermore, in the second embodiment, magnetic force generating portions are provided in the housing, and the plate-shaped member is constructed from a material that attracts magnetic force, but so long as the plate-shaped member can be removed from the housing, either the housing or the plate-shaped member may include magnetic force generating portions which generate a magnetic force, while at least one portion of the other is constructed from a material that attracts magnetic force.

Further, in the embodiments described above, the fixing unit was described as having a pair of roller-shaped rotating bodies which form the fixing roller and the pressure roller, but one of the rotating bodies may be given a film shape, while the other rotating body is given a roller shape.

For example, the fixing unit may be provided with a heating body supported on a support body, a heat-resistant film which is one rotating body is provided around the support body in a rotatable manner, and a pressure roller which is another rotating body that applies pressure to the heating body via the heat-resistant film, in which the film and the pressure roller form a nip. With this modification, by passing a recording medium carrying an unfixed toner image through such nip, the heat energy of the heating body is applied to the recording medium to carry out fixing.

Further, the fixing unit may be provided with a magnetic coil, a support body which supports the magnetic coil, a film which is one rotating body having a conductive layer and which moves through the magnetic field generated by the magnetic coil, and a pressure roller which is another rotating body that applies pressure to the support body via the film. With this modification, the film and the pressure roller form a nip, and by passing a recording medium carrying an unfixed toner image through such nip, the heat energy of the film is applied to the recording medium to carry out fixing.

Finally, it is to be understood that the present invention is not limited to the embodiments described above, and many changes or additions may be made without departing from the scope of the invention which is determined by the following claims.

What is claimed is:

1. A fixing unit for fixing a toner image onto a recording medium by passing the recording medium which carries an unfixed image between a pair of rollers which are rotated with being pressed to each other to apply heat and pressure to the recording medium thereby fixing the unfixed image onto the recording medium, the fixing unit comprising:

a housing in which the pair of rollers are provided, the housing having an outer surface;

a plate-shaped member for indicating information; and holding means for physically holding the plate-shaped member on the outer surface of the housing in such a manner that the plate-shaped member is attachable to and removable from the outer surface of the housing;

wherein the holding means includes spaced linear openings formed in the outer surface of the housing and portions of the plate-shaped member which are respectively inserted into the linear openings; and wherein the housing has a plurality of rib-shaped portions formed on the outer surface thereof, and some of the rib-shaped portions are formed with notches so as to provide an elongated space into which the plate-shape member is inserted.

2. The fixing unit as claimed in claim 1, wherein each of the rib-shaped portions has a ridge surface, and the ridge surfaces of the rib-shaped portions form a guide surface for guiding the recording medium along the outer surface of the housing in a longitudinal direction of the rib-shaped portions.

3. The fixing unit as claimed in claim 1 wherein the linear openings include a pair of slits formed in the outer surface of the housing in a spaced apart manner, and the positions of the plate-shaped member include opposite sides of the plate-shape member in a longitudinal direction thereof, wherein the opposite sides of the plate-shaped member are inserted into the slits, respectively.

4. The fixing unit as claimed in claim 3, wherein the holding means includes engagement portions comprised of holes formed in one of the housing and the opposite sides of the plate-shaped member and protrusions formed in the other to be engaged with the holes.

5. The fixing unit as claimed in claim 4, wherein the engaging portions are configured so as to allow the relative movement between the plate-shape member and the housing for absorbing thermal expansion of the plate-shaped member.

6. The fixing unit as claimed in claim 1, wherein the housing has an aperture for adjusting the distance between the axes of the pair of rollers from the outside of the housing and/or for adjusting the position of a component disposed in contact with or in the vicinity of the rollers, and the plate-shaped member is mounted so as to cover the aperture.

7. The fixing unit as claimed in claim 1, wherein the plate-shaped member is formed of a flexible material.

8. An image forming apparatus equipped with the fixing unit defined in claim 1.

* * * * *